US006183546B1

(12) United States Patent
McComas

(10) Patent No.: US 6,183,546 B1
(45) Date of Patent: Feb. 6, 2001

(54) COATING COMPOSITIONS CONTAINING NICKEL AND BORON

(75) Inventor: C. Edward McComas, Palm City, FL (US)

(73) Assignee: McComas Industries International, Richmond Hill (CA)

( * ) Notice: Under 35 U.S.C. 154(b), the term of this patent shall be extended for 0 days.

(21) Appl. No.: 09/184,055

(22) Filed: Nov. 2, 1998

(51) Int. Cl.[7] ..... C23C 18/34
(52) U.S. Cl. ..... 106/1.22; 106/1.27
(58) Field of Search ..... 106/1.22, 1.27

(56) References Cited

U.S. PATENT DOCUMENTS

| | | | | |
|---|---|---|---|---|
| 2,456,370 | | 12/1948 | Buck | 205/109 |
| 2,470,775 | | 5/1949 | Jernstedt et al. | 205/103 |
| 2,658,841 | | 11/1953 | Gutzeit | 427/438 |
| 2,726,170 | | 12/1955 | Warf et al. | 427/229 |
| 2,743,177 | | 4/1956 | Cape | 420/452 |
| 2,990,296 | | 6/1961 | Hoke | 427/437 |
| 3,045,334 | | 7/1962 | Berzins | 428/648 |
| 3,062,666 | | 11/1962 | McLeod | 106/1.27 |
| 3,096,182 | | 7/1963 | Berzins | 427/443.1 |
| 3,150,994 | | 9/1964 | Hoke | 427/443.1 |
| 3,268,353 | | 8/1966 | Melillo | 428/612 |
| 3,295,999 | | 1/1967 | Klein et al. | 106/1.22 |
| 3,297,418 | | 1/1967 | Firestone et al. | 428/671 |
| 3,338,726 | | 8/1967 | Berzins | 427/438 |
| 3,378,400 | | 4/1968 | Sickles | 427/437 |
| 3,403,035 | | 9/1968 | Schneble et al. | 427/443.1 |
| 3,432,338 | | 3/1969 | Sickles | 427/437 |
| 3,489,576 | | 1/1970 | Vincent | 427/438 |
| 3,533,922 | | 10/1970 | Semienko et al. | 205/260 |
| 3,562,000 | | 2/1971 | Parker | 427/383.7 |
| 3,637,472 | | 1/1972 | Sullivan | 205/263 |
| 3,674,447 | * | 7/1972 | Bellis | 428/639 |
| 3,738,849 | | 6/1973 | Bellis | 106/1.27 |
| 3,753,667 | | 8/1973 | Metzger et al. | 428/639 |
| 3,782,978 | | 1/1974 | Souza | 428/652 |
| 3,864,148 | | 2/1975 | Maeawa | 427/217 |
| 3,915,716 | * | 10/1975 | Haack | 106/1.22 |
| 3,917,464 | | 11/1975 | Pearlstein et al. | 428/679 |
| 4,002,778 | * | 1/1977 | Bellis et al. | 427/98 |
| 4,036,709 | | 7/1977 | Harbulak | 205/259 |
| 4,055,706 | | 10/1977 | Galmiche et al. | 428/652 |
| 4,059,217 | | 11/1977 | Woodward | 228/181 |
| 4,113,248 | | 9/1978 | Yanagioka | 473/566 |
| 4,167,416 | * | 9/1979 | Zolla | 106/1.27 |
| 4,169,171 | | 9/1979 | Narcus | 427/264 |
| 4,279,707 | | 7/1981 | Anderson et al. | 205/148 |
| 4,328,266 | | 5/1982 | Feldstein | 427/305 |
| 4,338,131 | | 7/1982 | Briggs, Jr. et al. | 148/103 |
| 4,440,609 | | 4/1984 | Blakeslee et al. | 205/259 |
| 4,483,711 | | 11/1984 | Harbulak et al. | 106/1.22 |
| 4,486,233 | | 12/1984 | Josso et al. | 106/1.22 |
| 4,621,026 | | 11/1986 | Robinson | 428/422 |
| 4,657,632 | | 4/1987 | Holtzman et al. | 106/1.22 |
| 4,661,216 | | 4/1987 | Anderson et al. | 205/260 |
| 4,715,894 | | 12/1987 | Holtzman et al. | 106/1.22 |
| 4,749,449 | | 6/1988 | Scott | 205/136 |
| 4,830,889 | * | 5/1989 | Henry et al. | 427/438 |
| 4,833,041 | * | 5/1989 | McComas | 428/610 |
| 4,844,739 | * | 7/1989 | Josso et al. | 106/1.27 |
| 4,894,124 | | 1/1990 | Walsh et al. | 205/167 |
| 4,983,428 | | 1/1991 | Hodgens, II | 427/443.1 |
| 5,017,410 | | 5/1991 | Hodgens, II | 427/443.1 |
| 5,019,163 | * | 5/1991 | McComas | 106/1.22 |
| 5,062,797 | | 11/1991 | Gonser | 433/118 |
| 5,213,907 | | 5/1993 | Caballero | 428/678 |
| 5,269,838 | * | 12/1993 | Inoue et al. | 106/1.22 |
| 5,314,608 | | 5/1994 | Caballero | 205/238 |
| 5,786,976 | | 7/1998 | Field | 361/215 |
| 5,871,810 | * | 2/1999 | Starcke et al. | 427/226 |

FOREIGN PATENT DOCUMENTS

0247839 * 12/1987 (EP) .

* cited by examiner

*Primary Examiner*—Helene Klemanski
(74) *Attorney, Agent, or Firm*—Fay, Sharpe, Fagan, Minnich & McKee, LLP

(57) ABSTRACT

The invention is directed to corrosion and wear resistant metallic coatings containing nickel, boron, and thallium. The coatings are preferably deposited on catalytically active substrates from an electroless coating bath containing nickel ions, a mixture of thallium nitrate and thallium sulfate as a stabilizer, a metal ion complexing agent, and a borohydride reducing agent, at a pH of about 10 to about 14.

31 Claims, No Drawings

COATING COMPOSITIONS CONTAINING NICKEL AND BORON

BACKGROUND OF THE INVENTION

This invention relates to novel metal coatings, which exhibit exceptional hardness. More particularly this invention relates to metal coatings containing nickel, boron and thallium to the reductive deposition of said coatings on the surfaces of substrate articles from aqueous solutions at an alkaline pH.

The plating or deposition of metal alloys by chemical or electrochemical reduction of metal ions on the surface of an article to modify its surface characteristics for both decorative and functional purposes is well known in the art. Of particular commercial significance is the deposition of metal/metal alloy coatings on both metal and activated non-metal substrates to enhance surface hardness and resistance to corrosion and wear. Nickel-boron and cobalt-boron alloy coatings are recognized in the art for their hardness and associated wear-resistance. The patent literature reflects an ongoing research and development effort in the area of nickel-boron coatings with the goal of producing still harder, more corrosion resistance coatings from a stable bath. For example, see, U.S. Pat. Nos. 5,019,163; 3,738,849; 3,674,447; 3,432,338; 3,378,400; 3,045,334; and 2,726,170. The art has recognized that when a borohydride reducing agent is used in a nickel/boron-plating bath a harder coating is achieved. However, borohydride, is very unstable in the bath. The solution to the stability problem has been to add stabilizers such as thallium salts such as thallium sulfate, or lead chloride to control the instability of the borohydride. The addition of stabilizers requires balancing the need for a proper plating rate with the need to control the stability of the borohydride. An over stabilized bath tends to plate slowly and co-deposit thallium in the coating.

The addition of the stabilizers created a new problem in the art by interfering with the formation of the nickel coating. During the formation of the nickel coating the stabilizer would co-deposit in the nickel coating thereby negatively impacting the hardness of the coating. In the case of thallium the hardness of the coating begins to decrease as the concentration of the thallium goes over three percent in the nickel coating.

As the bath ages there is a need to continuously add even additional thallium to achieve stability of the nickel/boron bath. During normal operation of the bath, boron and thallium salts are added every thirty minutes. As the bath ages the amount of thallium needed to stabilize the boroydride increases. This increase in concentration of thallium in the bath causes the concentration of the thallium in the nickel coating to increase. In a typical prior art bath such as Bellis or Klien the amount of thallium in the nickel coating can vary by as much as 50% over a two hour period of production. As the thallium concentration in the coating approaches 4% the hardness of the coating will be reduced by approximately 25%.

This invention solves the problem in the art of controlling the amount of thallium codeposited in the nickel coating as the bath ages while at the same time allowing for an acceptable plating rate. The inventor has discovered that by selecting a mixture of thallium sulfate and thallium nitrate the co-deposition of thallium in the nickel coating can be less than 4% as the bath ages. Preferably, thallium in the nickel coating can be less than 3% as the bath ages. At the same time the plating rate can be maintained at 1 mill per hour.

It is therefore a general object of this invention is to provide a method of electroless plating an article of manufacture or at least a portion of its surface with a hard, ductile, wear and corrosion resistant metal coating comprising both nickel, boron, and thallium from a bath containing a mixture of thallium sulfate and thallium nitrate so that the thallium codeposited in the coating is below 4%. Preferably the thallium codeposited in the coating is below 3%. And at the same time the plating rate can be maintained at 1 mill per hour.

An object of this invention is to provide improved metal alloy coating composition containing both nickel and boron and a mixture of thallium sulfate and thallium nitrate.

Another object of this invention is to provide coating baths from which a hard, ductile, wear and corrosion resistant coating can be deposited on at least a portion of the surface of a metal or activated non-metal substrate.

SUMMARY OF THE INVENTION

According to the present invention there is provided a novel metal coating composition containing both nickel and boron and a mixture of thallium sulfate and thallium nitrate. The coating composition can contain other metal ions. The coating composition is particularly useful for deposition on a surface of an article of manufacture, which is subject to exposure to corrosive conditions or one subject to sliding or rubbing contact with another surface under unusual wearing and bearing pressures. The metal coating of the present invention comprises about 85 to about 96.5 weight percent nickel, about 0.5 to about 10 weight percent boron and thallium not greater than about 4%. A preferred range for the nickel coating is 93–96 weight percent nickel and 2–5 weight percent boron and not greater than about 3% thallium. The coating is hard, yet ductile, and is highly corrosion and wear resistant.

It has now been surprisingly discovered that by using a mixture of thallium sulfate and thallium nitrate to stabilize a nickel-boron plating bath it becomes possible to control the amount of thallium codeposited in the nickel/boron coating as the bath ages and at the same time maintain an acceptable plating rate.

The present coating is preferably applied to a substrate electrolessly by contacting the substrate with a coating bath containing nickel ions, mixture of thallium sulfate and thallium nitrate, a metal ion complexing agent, and a borohydride reducing agent at pH about 10 to about 14 and at an elevated temperature of about 180 to about 210° F. The coating can be plated at lower temperatures after the plating has been initiated within a temperature range of about 180 to about 210° F.

DETAILED DESCRIPTION OF THE INVENTION

Suitable substrates for electroless deposition are those with so-called catalytically active surfaces including those composed of nickel, cobalt, iron, steel, aluminum, zinc, palladium, platinum, copper, brass, chromium, tungsten, titanium, tin, silver carbon, graphite and alloys thereof. Those materials function catalytically to cause a reduction of the metal ions in the plating bath by the borohydride and thereby result in deposition of the metal alloy on the surface of the substrate in contact with the plating bath. Aluminum usually requires a protective strike coat to prevent dissolution before plating. Non-metallic substrates such as glass, ceramics and plastics are in general, non-catalytic materials; however, such substances can be sensitized to be catalytically active by producing a film of one of the catalytic materials on its surface. This can be accomplished by a variety of techniques known to those skilled in the art. One preferred procedure involves dipping articles of glass, ceramic, or plastic in a solution of stannous chloride and then contacting the treated surface with a solution of palladium chloride. A thin layer of palladium is thereby reduced on the treated surface. The article can then be plated or coated with the metallic composition in accordance with this invention by contact with a coating bath as detailed below. It is to be noted that magnesium, tungsten carbide and some plastics have exhibited some resistance to deposition of the present coatings.

A coating bath for deposition of the present coatings comprises (1) Nickel ions, about 0.175 to about 2.10 moles per gallon. Calculations were based on a nickel chloride range of 0.05 to 0.6 pounds per gallon. A preferred range of nickel ions is about 0.35 to about 1.57 moles per gallon based on 0.1 to about 0.45 pound per gallon of nickel chloride;

(2) An effective amount of a chemical agent for adjusting the pH of the bath to between about 10 and about 14;

(3) about 2.26 to about 6.795 moles per gallon of metal ion complexing agent, preferably 3.3 to 3.8 moles per gallon (4) about 0.03 to about 0.1 moles per gallon of coating bath of a borohydride reducing agent based on BH4 preferably 0.045 to 0.08 moles per gallon of bath;

(5) 0.0508 grams per gallon and 0.11872 grams per gallon, preferably, between about 0.06784 grams per gallon and 0.10176 grams per gallon, and more preferably between about 0.075 grams per gal and 0.092 grams per gal of a mixture containing thallium sulfate and thallium nitrate. The best results falling between about 0.0806 and 0.0858 grams per gallon of the mixture containing thallium sulfate and thallium nitrate of as a stabilizer. The percentage of thallium nitrate in the mixture is less than 50% of the combined weight of the thallium nitrate and thallium sulfate; preferably between about 3% to about 38% thallium nitrate of the combined weight of the thallium nitrate and thallium sulfate; and more preferably between about 3% to about 10% thallium nitrate of the combined weight of the thallium nitrate and thallium sulfate; and the best result between about 5% to about 7% thallium nitrate of the combined weight of the thallium nitrate and thallium sulfate.

The borohydride reducing agent can be selected from among the known borohydrides having a good degree of water solubility and stability in aqueous solutions. Sodium borohydride is preferred. In addition, substituted borohydrides in which not more than three of the hydrogen atoms of the borohydride ion have been replaced can be utilized. Sodium trimethoxyborohydride [$NaB(OCH_3)_3H$] and potassium trimethoxyborohydride [$KB(OCH_3)_3H$] are illustrative of that type of compound.

The coating bath is prepared to have a pH of about 12 to about 14. Best results have been observed when the pH of the bath is maintained during the coating process within that range and more preferably at about pH 13.5. Adjustment of bath pH can be accomplished by addition of any of a wide variety of alkaline salts or solutions thereof. Preferred chemical agents for establishing and maintaining bath pH are the alkali metal hydroxides, particularly sodium and potassium hydroxide, and ammonium hydroxide. Ammonium hydroxide offers an additional advantage in that the ammonium ion can function to assist metal ion complexing in the coating bath.

Due to the high alkalinity of the coating bath, a metal ion complexing or sequestering agent is required in the bath to prevent precipitation of the metal ions such as nickel and other metal hydroxides or other basic salts. Importantly, too, the metal ion complexing agent functions to lower metal ion reactivity; the complexed or sequestered metal ions have minimal reactivity with the borohydride ions in the bulk solution but do react at the catalytic surfaces of substrates in contact with the solution. The term catalytic surface refers to the surface any article composed of the aforementioned catalytic materials or to the surface of a non-catalytic material which has been sensitized by application of a film of said catalytic materials on its surface.

The complexing or sequestering agents suitable for use in this invention include ammonia and organic complex-forming agents containing one or more of the following functional groups: primary amino, secondary amino, tertiary amino, immino, carboxy and hydroxy. Many metal ion complexing agents are known in the art. Preferred complexing agents are ethylenediamine, diethylene triamine, triethylene tetramine, triethylenetriamine the organic acids, oxalic acid, citric acid, tartaric acid and ethylene diamine tetraacetic acid, and the water soluble salts thereof. The most preferred is ethylene diamine.

About 2.26 to about 6.795 moles per gallon of complexing agent are used per gallon of coating bath. This calculation was based on 0.3 to about 0.9 pound per gallon of ethylenediamine. Best results have been obtained when about 3.39 to about 3.77 moles per gallon of coating bath. This calculation was based on about 0.45 to about 0.5 pound per gallon of ethylenediamine for each gallon of coating bath.

The, metal ions like nickel in the coating bath are provided by the addition to the bath of the respective water soluble salts. Any salts of those metals having an anion component which is not antagonistic to the subject coating process is suitable. For example salts of oxidizing acid such as chlorate salts are not desirable since they will react with the borohydride reducing agent in the bath. Nickel chlorides, sulfates, formates, acetates, and other salts whose anions are substantially inert with respect to the other ingredients in the alkaline coating bath are satisfactory.

The stabilizer is added to the bath from a concentrate. The concentrate contains about 28 to about 37 grams per gallon of the mixture containing thallium sulfate and thallium nitrate as a stabilizer. The preferred range of a mixture, preferably is about 31 to about 33 grams per gallon. The percentage of thallium nitrate in the mixture is less than 50% of the combined weight of the thallium nitrate and thallium sulfate; preferably between about 3% to about 38% of the combined weight of the thallium nitrate and thallium sulfate; and more preferably between about 3% to about 10% of the combined weight of the thallium nitrate and thallium sulfate; and the best result between about 5% to about 7% of the combined weight of the thallium nitrate and thallium sulfate.

The pH of the concentrate is usually above 7, preferably at 10.5. A pH modifier is added to the concentrate to adjust the pH. The pH modifier is selected from those bases such as sodium hydroxide, that are not harmful to the plating bath.

The concentrate is added to the bath so that upon dilution the concentration of the mixture containing thallium sulfate and thallium nitrate in the bath can range between 0.0508 grams per gallon and 0.11872 per gallon, preferably, between about 0.06784 grams per gallon and 0.10176 grams per gallon, and more preferably between about 0.075 grams per gallon and 0.092 grams per gallon of a mixture containing thallium sulfate and thallium nitrate. The best results falling between about 0.0806 and 0.0858 grams per gallon of the mixture containing thallium sulfate and thallium nitrate.

The coating bath is typically prepared by forming an aqueous solution of the appropriate amounts of metal salts, adding the complexing agent(s) and stabilizer, adjusting the pH to about 12 to about 14, heating to about 195° F., filtering and finally, immediately before introducing the substrate into the bath, adding the required amounts of sodium borohydride (typically in aqueous alkaline solution).

The article to be coated or plated using a bath in accordance with this invention is prepared by mechanical cleaning, degreasing, anode-alkaline cleaning, and finally pickling in an acid bath in accordance with the standard practice in the metal-plating art. The substrate can be masked if necessary to allow deposition of the metal alloy coating only on selected surfaces. Although the present coatings in general exhibit excellent adhesion to properly prepared substrate surfaces, in instances where coating adhesion is critical or where some adhesion problems are experienced, coating-adhesion can often be enhanced by depositing a nickel strike electrochemically on the substrate surface prior to applying the present coating.

The cleaned or otherwise surface-prepared article is immersed in the hot (about 180 to about 210° F.) coating bath to initiate the coating process. The process is continued until deposition of the coating has progressed to the desired thickness or until the metal ions are depleted from solution. Deposition rates vary under the conditions of the present process from about 0.1 mil (1 mil=one one-thousandth of an inch) to about 1.5 mil per hour. The preferred plating rate is about 1 mil per hour.

The preferred range of the ingredients of the plating bath comprises about 0.35 to about 1.57 moles per gallon nickel, about 0.0806 to about 0.0858 grams per gallon of a mixture containing thallium sulfate and thallium nitrate of as a stabilizer, preferably ions, about 0.045 to about 0.08 moles per gallon of borohydride. The ratio of nickel, boron and thallium in the present coatings can be adjusted by varying the relative amounts of the metal salt components and borohydride in the coating bath.

Under normal usage conditions of the coating baths in accordance with the present invention, a mixture containing thallium sulfate and thallium nitrate as a stabilizer, and a borohydride reducing agent are added to the coating bath every thirty minutes in amount equivalent to their usage in preparation of the bath initially. The need to replenish the present coating baths with thallium salts and borohydride depends on the ratio of coating bath volume to the surface area being coated. Thus replenishment of thallium salts and borohydride to the present coating bath would not be required when small surface areas are being treated.

One gallon of bath prepared in accordance with the preferred embodiment of the present invention will coat approximately 144 square inches to a thickness of 1 mil. For this result to be achieved the bath is replenished with thallium salts and borohydride in accordance with the above description as those components are depleted from solution.

The pH of the coating bath will tend to drop during the coating process and should be checked periodically to assure that it is within the preferred pH range of about 12 to about 14. It has been found that any problems with pH maintenance throughout the use of a coating bath can be minimized simply by using a highly alkaline (concentrated sodium hydroxide) solution of borohydride to replenish the borohydride content of the bath as required. The coating deposition rate from the present electroless coating bath is about 0.1 to about 1.5 mil per hour and is dependent on bath temperature, pH, and metal ion concentration. The deposition rate on most metal substrates from freshly prepared coating baths at a preferred temperature of about 185 to about 195° F. is approximately 1 mil per hour.

The practical aspects carrying out electroless coating processes are well known in the art. Such processes are disclosed generally in U.S. Pat. No. 5,109,613 issued to McComas on May 28, 1991; U.S. Pat. No. 3,338,726 issued to Berzins on Aug. 19, 1967; U.S. Pat. No. 3,096,182 issued to Berzins on Jul. 2, 1963; U.S. Pat. No. 3,045,334 issued to Berzins on Oct. 1, 1958; U.S. Pat. No. 3,378,400 issued to Sickles on Apr. 16, 1968; and U.S. Pat. No. 2,658,841 issued to Gutzeit and Krieg on Nov. 10, 1953; the disclosures of which are hereby incorporated by reference.

The electroless nickel coatings of the present invention exhibit excellent hardness and concomitant wear resistance. They are highly ductile allowing the coating to flex with the substrate while maintaining a strong bond to the coated material. The coatings appear to be amorphous, and nonporous.

The coatings are usually heat treated. The heat treatment is accomplished at a temperature of about 375 to about 750° F. for a period of about one to about 24 hours. Shorter times, about one to two hours, is preferred at higher temperatures of between about 550–750° F. Longer heat treatment times have been shown to be advantageous at the lower temperature ranges of between about 375 to about 450° F.

The structure of the nickel/boron coating changes during heat treatment. Before heat treatment the nickel and boron appear to combine to form a alloy. After heat treatment nickel boride is formed. The coating appears to be a nickel boride dispersion within the nickel/boron alloy.

The present coatings have a wide range of applications, which will be recognized by those skilled in the art. They have particular utility for coating surfaces of articles that under normal use are subjected to highly abrasive, rubbing, or sliding conditions under high temperatures/pressures. Such high wear conditions are found at many points in construction of tools, internal combustion engines including gas turbine engines, transmissions and in a wide variety of heavy equipment construction applications.

The following example provide details of bath compositions, process conditions, and coating compositions and properties representative of the present invention. The example is illustrative of the invention and are not in any way to be taken as limiting the scope thereof.

EXAMPLE I

A one (1) gallon batch unit of coating bath was prepared as follows. For the purposes of this example, four solutions were prepared: A (the bath), B (the reducer), C (the stabilizer), and D (the bath replenisher). First, one gallon batches of each solution were prepared. Solution A was made as follows; 1) 114 grams of nickel chloride, was added to a 1 gallon beaker containing a half (0.5) gallon of de-ionized water 2) 227 grams of ethylenediamine was added as a complexing agent; and 3) 150 grams of sodium hydroxide was added to the beaker and de-ionized water was added to fill the beaker to the one gallon mark.

Solution B (the reducer) was made as follows 1) adding 1135 grams of sodium hydroxide to a half of gallon of de-ionized water; 2) allowing the solution to cool then adding 363 grams of sodium borohydride. Additional water was added to increase the level to one gallon Solution C (the stabilizer) consisted of one gallon of deionized water containing 32 grams of thallium nitrate in an alkaline medium.

Solution D (the bath replenisher) consisted of deionized water, 0.75 lb. of nickel chloride, 1.5 lbs. of ethylenediamine and 1.0 lb. of sodium hydroxide. This solution is added to the bath when the nickel ions in the bath drops below 70% of the original concentration.

Solution A was heated to 192° F. Two 2"×2"×0.032 panels of mild steel were degreased with a solvent (methyl ethyl ketone) The panels were grit blasted with aluminum oxide (140 grit) and placed in a solution of 35% HCl in order to activate the parts. The panels were rinsed with de-ionized water and placed in Solution A. Just before the panels were placed into the bath for plating, 10 ml of Solution B mixed with 10 ml of Solution C were added to the heated Solution A. Ten ml of solution A is equal to 0.0832 grams of the thallium salt.

After 30 minutes, Solution A was titrated for the presence and amount of sodium borohydride. An additional 10 mls of Solution B and 10 mls of Solution C, mixed together, and were added after every 30 minutes of plating. The plating continued for 3 hours.

To show the benefits of using a mixture of thallium nitrate and thallium sulfate in proper proportions, example one was repeated by replacing the thallium nitrate with different proportions of the thallium nitrate and thallium sulfate.

In example 2, 32 grams of $TiSO_4$ was use as the stabilizer;

In example 3, 16 grams of $TiSO_4$ and 16 grams of $TiNO_3$ was used;

In example 4, 8 grams of $TiSO_4$ and 24 grams of $TiNO_3$ was used;

In example 5, 4 grams of $TiSO_4$ and 30 grams of $TiNO_3$ was used;

In example 6, 2 grams of $TiSO_4$ and 24 grams of $TiNO_3$ was used;

In example 7, 1 grams of $TiNO_3$ and 31 grams $TiSO_4$ Of was used;

In example 8, 2 grams of $TiNO_3$ and 30 grams $TiSO_4$ Of was used;

In example 9, 4 grams of $TiNO_3$ and 28 grams $TiSO_4$ Of was used;

In example 10, 8 grams of $TiNO_3$ and 24 grams $TiSO_4$ Of was used;

The results of the examples show how bath stability is a function of the amounts of $TiNO_3$ and TiSO4. Bath stability is defined as the ability to maintain a good plating rate such as 1 mill per hour and at the same time control the seeding in the bath and the thallium deposition in the coating. The results of the example is shown in the table.

(0) stable bath;

(−) bath slightly over stabilized, plating rate slow, about 0.8 mill per hour bath, coating is acceptable.

(−)(−) bath over stabilized resulting in a slower plating rate about 0.6 mill per hour, thallium in coating increased, coating is acceptable.

(−)(−)(−) bath very over stabilized plating rate slows to about 0.5 mill, coating unacceptable, has little or no nodules.

(−)(−)(−)(−) unacceptable coating.

(+) bath slightly under stabilized resulting in slightly increased plating rate of about 0.001 mill per hour, coating is good.

(+)(+) bath slightly under stabilized resulting in slightly fast plating rate of about 0.0013 bath tends to decompose but can recover by adding more stabilizer, coating is acceptable.

(+)(+)(+) bath very under stabilized resulting in fast plating rate causing nickel to seed out, coating is unacceptable acceptable.

* seeding

| | | | | | | |
|---|---|---|---|---|---|---|
| 1 | (0) | (−) | (−) (−) (*) | (−) (−) (−) (−) | STOP | |
| 2 | (0) | (−) | (−) (−) | (+) | (+) | (−) (−) (−) |
| 3 | (0) | (−) (−) | (+) (+) | (−) | (+) (+) (+) | STOP |
| 4 | (0) | (0) | (0) (−) | (−) (−) | (+) | (−) (−) (−) |
| 5 | (0) | (−) | (−) (−) (−) | (−) (−) (*) | (−) (−) (−) (−) | STOP |
| 6 | (0) | (0) | (0) (−) | (−) | (0) | (−) |
| 7 | (0) | (0) | (−) | (0) | (−) | (0) |
| 8 | (0) | (0) | (−) (−) | (0) | (+) | (−) |
| 9 | (0) | (−) | (−) (−) | (−) | (−) (−) | (−) (−) |
| | 30 MIN | 60 MIN | 90 MIN | 120 MIN | 150 MIN | 180 MIN |

These examples were run with the operator increasing or decreasing the amount of stabilizer in the bath to compensate for over stability or under stability. Example 2 illustrates the addition of stabilizer to adjust the stability of the bath. After 60 minutes the bath starts to become over stabilized requiring a cutback in the amount of stabilizer to be added. This cause the bath to become slightly under stabilized. After 150 minutes even with adjustments to the bath becomes so over stabilized that the coating become unstable. This example shows that the bath stability is difficult to maintain because of the tendency of the bath to swing back and forth. In contrast, examples 6–9 show a more stable bath. The tendency of the bath to have dramatic swings back and forth between over and under stability is minimized. Therefore the baths shown in examples 6–9 are more easily controlled and provide a more stable bath as the bath ages.

The desired plating rate is 0.001 inch per hour. Achieving this optimum plating rate requires adjusting the amount of the stabilizer so that the bath does not seed out by plating too fast or becomes over stabilized thereby resulting in too much thallium co-deposited in the nickel coat and a reduction in plating rate.

When the amount of stabilizer is low the plating speed increases causing bath decomposition or seed out. The nickel plates itself , forms small particles and drops to the bottom of the bath. Too much stabilizer slows the plating rate. This condition results in an unacceptable coating having nodules that are flat or nonexistent. By using a mixture containing thallium sulfate and thallium nitrate as the stabilizer one can maintain the desired plating rate over a longer time period as the bath ages in contrast to the prior art.

Example 7 which gave the best result was used to establish a concentration range for the mixture containing thallium sulfate and thallium nitrate in the bath. Example 7 was modified by varying the number of ml of solution C added to the bath. Example 10, repeated example 7, using 8 ml of solution C. The bath was stable for the first 90 minutes and for the next 60 minutes the bath became less stable but was still able to produce an acceptable coating. After 150 minutes the bath became unstable and the coating became unacceptable.

Example 11, repeated example 7, using 6 ml of solution C. The bath was stable for the first 30 minutes and for the next 30 minutes the bath became seedy and very dark. After 60 minutes the bath became too unstable.

Example 12, repeated example 7, using 12 ml of solution C. The coating was acceptable for 120 minutes but then the concentration of thallium in the coating became two high causing a significant decrease in the hardness of the coating. Plating stopped after 150 minutes, the bath had become over stabilized.

Example 13, repeated example 7, using 14 ml of solution C. After 30 minutes the concentration of thallium in the coating became two high causing a significant decrease in the hardness of the coating. The plating rate dropped to 0.0002 inch per hour. A plating rate of 0.001 inch per hour was desired. Plating stopped after 90 minutes.

These examples show that the mixture containing thallium sulfate and thallium nitrate in the bath should range between about 19.2 grams per gal and 44.8 grams per gal, preferably, between about 25.6 grams per gal and 38 grams per gal, and more preferably between about 25.6 grams per gal and 34 grams per gal. The best results would most likely fall between about 0.0806 and 0.0858 grams per gallon of the mixture.

With respect to the above description then, it is to be realized that the optimum proportions, process steps, and ingredients of the invention, to include variations in size, materials, shape, form, function and manner of operation, assembly and use, are deemed readily apparent and obvious to one skilled in the art, and all equivalent relationships to those described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. A coating bath for providing a hard, wear and corrosion resistant, ductile coating on a substrate, said bath having a pH of about 10 to about 14 and comprising (1) about 0.175 to about 2.10 moles per gallon of coating bath of nickel ions;

(2) about 0.0508 to about 0.11872 grams per gallon of a mixture containing thallium nitrate and thallium sulfate as a stabilizer wherein the percentage of thallium nitrate in the mixture is less than 50% of the combined weight of the thallium nitrate and thallium sulfate (3) an effective amount of metal ion complexing agent in an amount sufficient to inhibit precipitation of said metal ions from the coating bath;

(4) an effective amount of a borohydride reducing agent.

2. The coating bath of claim 1, wherein the metal ion complexing agent is selected from the group consisting of water soluble salts of tartaric acid, citric acid, oxalic acid, ethylenediamine, diethylenetriamine, triethylenetriamine, ethylenediamine tetraacetic acid and ammonia.

3. The coating bath of claim 1, wherein the metal ion complexing agent is ethylenediamine.

4. The coating bath of claim 6 wherein the borohydride reducing agent is selected from the group consisting of sodium borohydride, potassium borohydride, sodium trimethoxyborohydride, and potassium trimethoxyborohydride.

5. The coating bath of claim 1 wherein the borohydride reducing agent is sodium borohydride.

6. The coating bath of claim 1 wherein the borohydride con centration is about 0.03 to about 0.1 moles per gallon.

7. The coating bath of claim 1 containing from about 2.26 to about 6.795 moles of metal ion complexing compound per gallon of coating bath.

8. The coating bath of claim 1 wherein the nickel ion concentration is about 0.35 to about 1.57 moles per gallon.

9. The coating bath of claim 1 containing about 0.06784 to about 0.10176 grams per gallon of a mixture containing thallium nitrate and thallium sulfate as a stabilizer.

10. The coating bath of claim 9 containing about 0.0806 to about 0.0858 grams per gallon of a mixture containing thallium nitrate and thallium sulfate as a stabilizer.

11. The coating bath of claim 1 wherein the percentage of thallium nitrate in the mixture is between about 3% to about 38% of the combined weight of thallium nitrate and thallium sulfate.

12. The coating bath of claim 11 wherein the percentage of thallium nitrate in the mixture is between about 3% to about 10% of the combined weight of thallium nitrate and thallium sulfate.

13. The coating bath of claim 12 wherein the percentage of thallium nitrate in the mixture is between about 5% to about 7% of the combined weight of thallium nitrate and thallium sulfate.

14. The coating bath of claim 9 wherein the percentage of thallium nitrate in the mixture is between about 3% to about 38% of the combined weight of thallium nitrate and thallium sulfate.

15. The coating bath of claim 9 wherein the percentage of thallium nitrate in the mixture is between about 3% to about 10% the combined weight of thallium nitrate and thallium sulfate.

16. The coating bath of claim 9 wherein the percentage of thallium nitrate in the mixture is between about 5% to about 7% of the combined weight of thallium nitrate and thallium sulfate.

17. The coating bath of claim 10 wherein the percentage of thallium nitrate in the mixture is between about 3% to about 38% of the combined weight of thallium nitrate and thallium sulfate.

18. The coating bath of claim 10 wherein the percentage of thallium nitrate in the mixture is between about 3% to about 10% the combined weight of thallium nitrate and thallium sulfate.

19. The coating bath of claim 10 wherein the percentage of thallium nitrate in the mixture is between about 5% to about 7% of the combined weight of thallium nitrate and thallium sulfate.

20. A concentrate containing about 28 to about 37 grams per gallon of mixture containing thallium sulfate and thallium nitrate, wherein the percentage of thallium nitrate in the mixture is less than 50% of the combined weight of the thallium nitrate and thallium sulfate.

21. A concentrate according to claim 20 wherein the mixture contains about 31 to about 33 grams per gallon of a mixture containing thallium nitrate and thallium sulfate.

22. A concentrate according to claim 20 wherein the percentage of thallium nitrate in the mixture is between about 3% to about 38% of the combined weight of thallium nitrate and thallium sulfate.

23. A concentrate according to claim 22 wherein the percentage of thallium nitrate in the mixture is between about 3% to about 10% of the combined weight of thallium nitrate and thallium sulfate.

24. A concentrate according to claim 22 wherein the percentage of thallium nitrate in the mixture is between about 5% to about 7% of the combined weight of thallium nitrate and thallium sulfate.

25. A concentrate according to claim 21 wherein the percentage of thallium nitrate in the mixture is between about 3% to about 38% of the combined weight of thallium nitrate and thallium sulfate.

26. A concentrate according to claim 21 wherein the percentage of thallium nitrate in the mixture is between about 3% to about 10% of the combined weight of thallium nitrate and thallium sulfate.

27. A concentrate according to claim 26 wherein the percentage of thallium nitrate in the mixture is between about 5% to about 7% of the combined weight of thallium nitrate and thallium sulfate.

28. A concentrate according to claim 20 having a pH of at least 7.

29. A process of electrolessly coating an article in which said article is placed in a coating bath having the composition of claim 1.

30. A process of making a coating bath having the composition of claim 1 by forming an aqueous solution of the of metal salts, adding the complexina agent(s) and stabilizer, adjusting the pH to about 12 to about 14, heating to about 195° F., filtering and, just prior to introducing the substate into the bath, adding sodium borohydride.

31. The process according to claim 30 wherein the sodium borohydride is added as an aqueous alkaline solution.

* * * * *